United States Patent [19]

Bucheder

[11] 4,407,048

[45] Oct. 4, 1983

[54] BUCKLE FOR FASTENING TOGETHER THE PARTS OF A SHOE

[75] Inventor: Erwin Bucheder, Köflach, Austria

[73] Assignee: Koflach Sportgerate Gesellschaft m.b.H., Koflach, Austria

[21] Appl. No.: 268,114

[22] Filed: May 28, 1981

[30] Foreign Application Priority Data

Jun. 27, 1980 [AT] Austria ..... A 3390/80

[51] Int. Cl.[3] ..... A43C 11/00

[52] U.S. Cl. ..... 24/69 SK; 24/71 SK

[58] Field of Search ..... 24/69 SK, 68 SK, 71 R, 24/71 ST, 71 SK, 70 SK

[56] References Cited

U.S. PATENT DOCUMENTS 4,104,766 8/1978 Szlomon ..... 26/69 SK 4,280,432 7/1981 Dessel ..... 24/71 CT

*Primary Examiner*—Robert Peshock

*Attorney, Agent, or Firm*—Cushman, Darby & Cushman

[57] ABSTRACT

The buckle for fastening together the parts of a shoe comprises a tightening lever (1), which consists substantially of two parts (2, 3), which are displaceable relative to each other in the longitudinal direction of the tightening lever (1) and are guided relative to each other. One part (2) of the tightening lever is pivoted to the outside surface of the shoe and is adapted to be connected to a tensile element (15) so that the latter will be tensioned by a pivotal movement of the part (2) of the tightening lever (1). The tightening lever (1) ist locked in its closed position in that its second part (3) is displaced beyond the hinge pin (9) for the tightening lever (1) (FIG. 1).

11 Claims, 5 Drawing Figures

BUCKLE FOR FASTENING TOGETHER THE PARTS OF A SHOE

Figure 1:
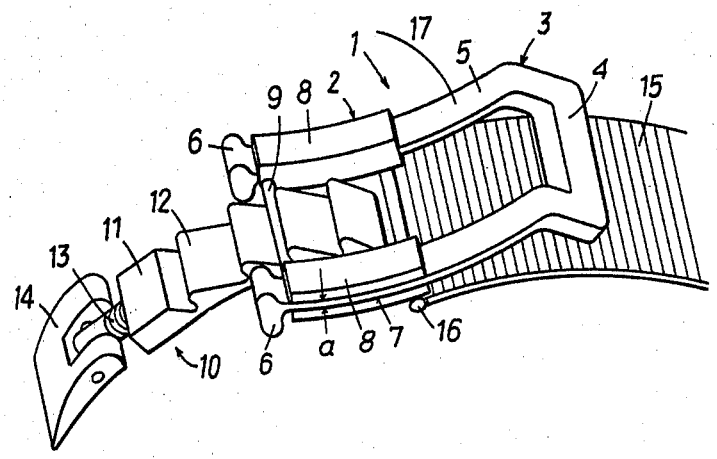

This invention relates to a buckle for fastening together the parts of a shoe, particularly of a skiing boot or mountaineering boot, comprising a tightening lever, which is pivoted on a hinge pin that is transverse to the longitudinal axis of a tensile element, which is adapted to be secured to the surface of the shoe and to be connected to the tightening lever, and an abutment cooperating with the tightening lever. In the use of such buckles, the tensile element is inserted, as a rule, into the tightening lever in one of a plurality of positions and the tightening lever is then pivotally moved about its hinge axis to fasten together the parts of the shoe. During the tightening movement, the lever moves through a dead-center position so that the tensile forces exerted by the tensile element hold the tightening lever in its closed position. The angular movement between the dead-center position and the closed position is usually very small because the dimension of the buckle is limited. Such buckles can be inadvertently opened by shakes during skiing or because the buckle collides with rock during mountaineering. Besides, the holding of such buckles in the closed position will not be ensured with reasonable reliability unless relatively strong tensile forces are exerted. For this reason a buckle which exerts only small tensile forces on the tensile element will be more liable to be opened inadvertently.

It is an object of the invention so to improve a buckle of the kind described first hereinbefore that it will be reliably maintained in its closed position even when strong tensile forces are not exerted on the tensile element, and that the buckle will not readily open in response to shakes and collisions. This object is accomplished according to the invention essentially in that the tightening lever comprises two parts, which are displaceable relative to another in its longitudinal direction and are guided relative to each other, that the tensile element is adapted to be secured to one of the two parts of the lever, and that the second part of the tightening lever constitutes a handle and in the closed position is adapted to be displaced toward the tensile element beyond the hinge pin for the tightening lever. Because the tightening lever comprises two parts, which are displaceable relative to each other in the longitudinal direction of the lever and are guided relative to each other, only one of the two parts of the tightening lever, namely, the part which constitutes a handle, can be displaced toward the tensile element beyond the hinge pin for the tightening lever when the same is in its closed position. That part of the tightening lever which has been displaced beyond the hinge pin for the tightening lever will then prevent an opening of the buckle. The tensile element is adapted to be secured to the nondisplaceable part of the lever and is preferably pivoted to the tightening lever on a pivot pin that is transverse to the longitudinal axis of the tensile element. Such pivotal connection of the tensile element to the tightening lever will permit the use of stiff tensile elements without adversely affecting the function of the buckle. That pivot pin for the tensile element is parallel to the hinge pin for the tightening lever.

To permit an adjustment of the tension, the hinge pin for the tightening lever may be adapted to be latched into abutments, which are connected to the shoe and are preferably adjustable relative to the shoe. Alternatively, an anchoring member may be provided, which is pivoted on the hinge pin for the tightening lever and has at least one opening or elevation and is adapted to be non-positively connected to an abutment, which is connected to the shoe. In the former case the hinge pin for the tightening lever is non-positively fixed to the surface of the shoe in various positions. In the second case the adjustment is effected by a fixation of various openings or elevations of the anchoring member on the abutment.

The adjustment of the second or handle part of the tightening lever may be permitted in a simple manner in that that part of the tightening lever which is adapted to be connected to the tensile element has at least one profiled hollow portion which extends transversely to the hinge pin for the tightening lever and that that part which is displaceable beyond the hinge pin for the tightening lever is guided in that the hollow portion. Such profiled hollow portion will ensure the guidance of the displaceable part on the pivoted part of the tightening lever and will also ensure that the two parts of the tightening lever cannot be readily separated from each other in the closed position. The arrangement is preferably such that the tightening lever comprises two longitudinal channels, which are connected by the hinge pin for the tightening lever, and in that the displaceable part of the tightening lever is guided in both longitudinal channels.

In order to prevent an unintended pulling of the displaceable part of the tightening lever out of its track and the loss of that displaceable part, the displaceable part of the tightening lever is preferably angled at its end remote from the handle or at that end its cross-section is larger than the inside cross-section of the track, particularly of the profiled hollow portion or the longitudinal channels, and the part is particularly formed there with an enlarged head. When the displaceable part has been pulled out as far as possible, that portion of the cross-section of the end portion of the displaceable part of the tightening lever which exceeds the inside cross-section of the track engages the track so that the displaceable part cannot be entirely removed and is thus held captive. If that cross-section of the displaceable part which is larger than the inside cross-section of the track is provided with an enlarged head, as is preferred, the preferred head of the displaceable part of the tightening lever my have a crowned outside surface on the side remote from the profiled hollow portion so that only a gentle action will be exerted on the surface of the shoe during the pivotal movement of the tightening lever.

In a simple embodiment, the displaceable part of the tightening lever is substantially U-shaped and in the region between its legs is angled out of the plane of the U to form a handle. This design will be particularly inexpensive.

The invention will now be explained more fully with reference to illustrative embodiments shown on the drawing.

Figure 2:
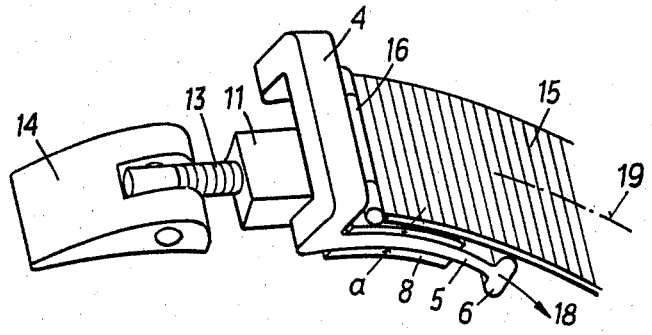
Figure 3:
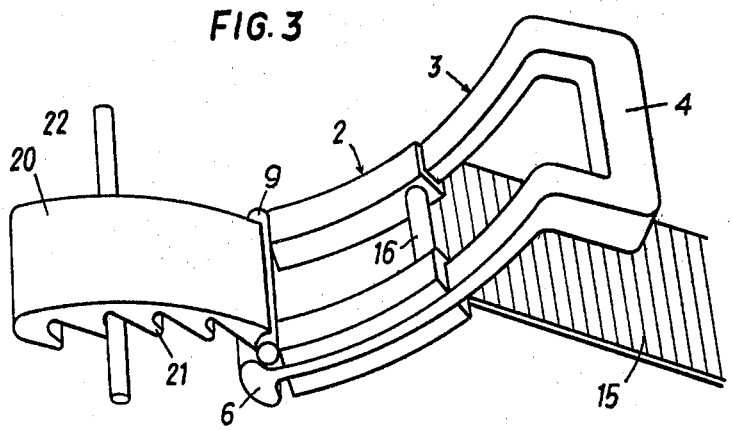
Figure 4:
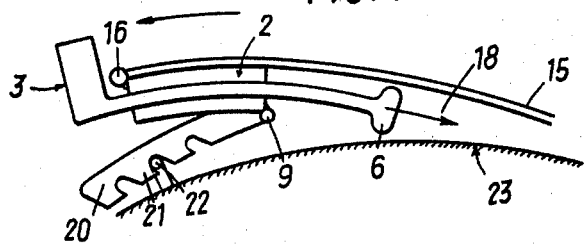
Figure 5:
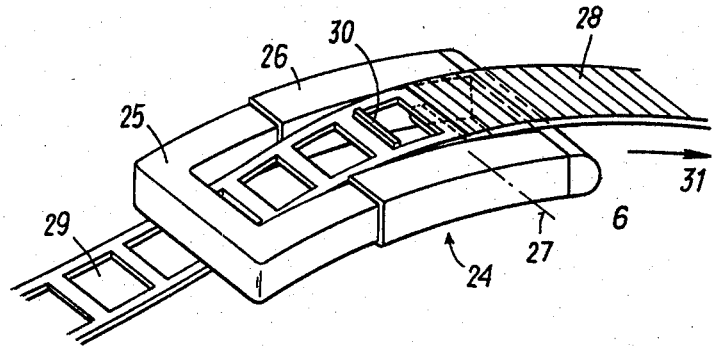

FIGS. 1 and 2 are perspective views showing a first embodiment of the buckle in open and closed positions, respectively. FIGS. 3 and 4 show a second embodiment of the buckle according to the invention. FIG. 5 shows a third embodiment of the buckle.

The tightening lever 1 shown in FIGS. 1 and 2 comprises a first part 2 and a part 3, which is guided in and displaceable relative to the part 2. The part 3 of the tightening lever 1 is angled to form a handle 4 and is substantially U-shaped. To provide a crowned head 6 having a cross-section which is larger than the inside cross-section a of the track 7 of the first part 2, the free ends of the legs 5 of the displaceable part 3 are enlarged in width. In this embodiment the pivoted part 2 of the tightening lever 1 consists of two longitudinal channels 8, which are interconnected by the hinge pin 9 for the tightening lever. That hinge pin 9 is latched into an abutment 10, which in the embodiment shown in FIGS. 1 and 2 consists of a rack 11 having teeth 12, which are inclined opposite to the direction of tension. The rack 11 is longitudinally adjustably pivoted by a screw 13 to a bracket 14, which is connected to the shoe. The tensile element 15 is pivoted to the part 2 of the tightening element on a pivot pin 16, which is parallel to the hinge pin 9 for the tightening lever 1. When it is desired to close the tightening lever 1, which is shown in its open position in FIG. 1, the tightening lever 1 must be pivotally moved in the sense indicated by the arrow 17 in FIG. 1 to the position shown in FIG. 2. In the closed position, the displaceable part 3 of the tightening lever can be displaced relative to the part 2 in the direction indicated by the arrow 18 in FIG. 2. As a result, the legs 5 of the displaceable part 3 are moved in the direction of the longitudinal axis 19 of the tensile element 15 beyond the hinge pin 9 so that an inadvertent opening, i.e., an inadvertent pivotal movement of the tightening lever 1 about the hinge pin 9, will be prevented. The enlarged head 6 of the legs 5 of the displaceable part 3 of the tightening lever 1 may be in frictional contact with the underside of the tensile element 15, i.e., with that side of the tensile element 15 which faces the shoe, so that an inadvertent opening of the tightening lever 1 is even less likely to occur.

In the embodiment shown in FIG. 3, an anchoring member 20 is connected to the hinge pin 9 for the tightening lever 1, which is substantially identical to that shown in FIGS. 1 and 2. The spaces between the teeth 21 may be non-positively connected in various positions to an abutment, which is diagrammatically indicated as a pivot pin 22 and is secured to the outside of the shoe. When the tightening lever 1 is then pivotally moved, the buckle will assume its closed position, which is diagrammatically shown in FIG. 4. To hold the buckle in that closed position the displaceable part 3 of the tightening lever 1 is again displaced relative to the part 2 in the direction of the arrow 18. In all essential details, the means for guiding the part 3 on the part 2 are the same as shown in FIGS. 1 and 2 so that the description need not be repeated.

In FIG. 4, the outside surface of the shoe is designated 23. If the buckle is used to close a slit of that shoe, the tensile element 15 will be connected to one part of the shoe and the tightening lever 1 will be connected to the other part of the shoe in the closed position of the buckle. In that embodiment the hinge pin for the tightening lever may be rigidly connected to the shoe.

In the embodiment shown in FIG. 5, a tightening lever 24 comprises a substantially U-shaped handle part 25, which is guided in profiled hollow portions 26 of the tightening lever 24, which is pivoted on a hinge pin 27. The tensile element 28 is formed at its free ends with through apertures, which can be operatively connected in various positions to a projection 30 of the tightening lever 24. When the tightening lever 28 has been closed, the part 25 of the tightening lever 24 can be displaced in the direction of the arrow 31 in order to lock the buckle against opening inadvertently.

What is claimed is:

1. A buckle for fastening together the parts of a shoe, particularly of a skiing boot or mountaineering boot, comprising an elongated tensile element, a tightening lever pivoted on a hinge pin that is transverse to the longitudinal axis of the tensile element, which is adapted to be secured to the surface of the shoe, and an abutment adapted to be connected to the shoe and cooperating with the tightening lever, said lever and abutment being on different parts of the shoe and being engageable to draw the shoe parts toward each other when said lever is swung to a closed position, characterized in that the tightening lever comprises first and second parts, which are longitudinally displaceable relative to each other and are guided relative to each other, that the tensile element is adapted to be secured to said first part of the lever, and that the second part of the tightening lever constitutes a handle which, after the lever has been swung to the closed position, can be displaced relative to said first part toward the tensile element longitudinally beyond the hinge pin of the tightening lever.

2. A buckle according to claim 1, characterized in that the tensile element is pivoted to the tightening lever by a pivot pin that is transverse to the longitudinal axis of the tensile element and that the hinge pin for the tightening lever is parallel to said pivot pin and connected to the tightening lever.

3. A buckle according to claim 1 or 2, characterized in that the hinge pin for the tightening lever is adapted to be latched into said abutment.

4. A buckle according to claim 1 or 2, characterized in that an anchoring member is provided, which is pivoted on the hinge pin for the tightening lever and has at least one opening or elevation and is adapted to be non-positively connected to said abutment.

5. A buckle according to claim 1, characterized in that that part of the tightening lever which is adapted to be connected to the tensile element has at least one profiled hollow portion, which extends transversely to the hinge pin for the tightening lever, and that part which is displaceable beyond the hinge pin for the tightening lever is guided in that hollow portion.

6. A buckle according to claim 1, characterized in that the tightening lever has two longitudinal channels, which are connected by the hinge pin for the tightening lever, and the displaceable part of the tightening lever has portions guided in both longitudinal channels.

7. A buckle according to claim 6 characterized in that said portions of the displaceable part of the tightening lever are angled at their ends remote from the handle.

8. A buckle according to claim 1, characterized in that the displaceable part of the tightening lever is substantially U-shaped and in that the region between its legs is angled out of the plane of the U to form a handle.

9. A buckle as in claim 6 wherein said portions of the displaceable part of the tightening lever at their ends remote from the handle are formed with an enlarged head.

10. A buckle system for fastening together parts of a shoe, said system comprising: a lever having a longitudinal dimension and having an inner end carrying a transverse hinge pin and an outer end which serves as a handle for manually swinging said lever about said hinge pin between a buckle-open position and buckle-closed position, said lever including first and second parts which are longitudinally displaceable relative to each other, said second part extending longitudinally beyond the first part in both directions and having first and second ends forming said inner end and said outer end, respectively, of said lever, said first end bearing against a surface of the shoe, and said first part carrying said hinge pin, a tensile element extending longitudinally of said lever and having one end connected to the shoe and an opposite end attached to said first part of said lever by a connection which is located such that swinging movement of said lever from its open position to said closed position moves said connection longitudinally with respect to said lever from a first position on one side of said hinge pin to a second position on the opposite side of said hinge pin; and a toothed member attached to the shoe in a position such that said hinge pin is engageable therewith in a manner to apply tension to said tensile element when said lever is swung from its open position to its closed position, whereupon said second lever part can be manually displaced relative to said first lever part in a direction toward said tensile element so that said first end of said second lever part becomes longitudinally spaced from said hinge pin.

11. A buckle system for fastening together parts of a shoe, said system comprising: a lever having a longitudinal dimension and having an inner end carrying a transverse hinge pin and an outer end which serves as a handle for manually swinging said lever about said hinge pin between a buckle-open position and buckle-closed position, said lever including first and second parts which are longitudinally displaceable relative to each other, said second part extending longitudinally beyond the first part in both directions and having first and second ends forming said inner end and said outer end, respectively, of said lever, said first end bearing against a surface of the shoe, and said first part carrying said hinge pin, a tensile element extending longitudinally of said lever and having one end connected to the shoe and an opposite end attached to said first part of said lever by a connection located such that swinging movement of said lever from its open position to said closed position moves said connection longitudinally with respect to said lever from a first position on one side of said hinge pin to a second position on the opposite side of said hinge pin; an abutment element attached to the shoe; and a toothed member attached to said first lever part by said hinge pin in a position such that a tooth thereof is engageable with said abutment element in a manner to apply tension to said tensile element when said lever is swung from its open position to its closed position, whereupon said second lever part can be manually displaced relative to said first lever part in a direction toward said tensile element so that said first end of said second lever part becomes longitudinally spaced from said hinge pin.

* * * * *